US005346049A

United States Patent [19]

Nakajima et al.

[11] Patent Number: 5,346,049

[45] Date of Patent: Sep. 13, 1994

[54] COIN DISCRIMINATOR USING A PLURALITY OF OPTICAL FIBER GROUPS

[75] Inventors: Tohru Nakajima; Mituhiro Nagase, both of Tokyo, Japan

[73] Assignee: Laurel Bank Machines Co., Ltd., Tokyo, Japan

[21] Appl. No.: 159,599

[22] Filed: Dec. 1, 1993

[30] Foreign Application Priority Data

Dec. 2, 1992 [JP] Japan ..... 4-323451
Nov. 25, 1993 [JP] Japan ..... 5-295309

[51] Int. Cl.[5] ..... G07D 5/00

[52] U.S. Cl. ..... 194/328; 250/227.11; 250/228

[58] Field of Search ..... 194/302, 328, 329, 330, 194/331; 250/227.11, 228

[56] References Cited

U.S. PATENT DOCUMENTS

| | | | |
|---|---|---|---|
| 1,897,219 | 2/1933 | Schroter | 250/228 X |
| 3,458,261 | 7/1969 | Bentley et al. | 250/228 X |
| 3,978,962 | 9/1976 | Gregory, Jr. | 194/328 |
| 4,333,557 | 6/1982 | Kozak | 194/328 X |
| 4,542,817 | 9/1985 | Paulson | 194/328 X |
| 4,703,187 | 10/1987 | Hofling et al | 250/228 X |
| 5,236,074 | 8/1993 | Gotaas | 194/328 X |

FOREIGN PATENT DOCUMENTS

| | | | |
|---|---|---|---|
| WO90/0083-68 | 7/1990 | European Pat. Off. . | |
| 3305509 | 8/1984 | Fed. Rep. of Germany | 194/328 |
| 47-45039 | 11/1972 | Japan . | |
| 0204891 | 8/1990 | Japan | 194/328 |
| 0259982 | 10/1990 | Japan | 194/328 |
| 3-63782 | 10/1991 | Japan . | |
| 2227347 | 7/1990 | United Kingdom . | |

*Primary Examiner*—Michael S. Huppert
*Assistant Examiner*—Scott L. Lowe
*Attorney, Agent, or Firm*—Cushman, Darby & Cushman

[57] ABSTRACT

A coin discriminating apparatus including a light source for irradiating the surface of a coin to be discriminated with light normal thereto, a plurality of optical fiber groups each including a plurality of optical fibers for guiding light reflected by the surface of the coin to be discriminated, each of the optical fibers disposed so that an imaginary extension of the center axis thereof passes through the center of the surface of the coin to be discriminated at a predetermined angle, the predetermined angle being different between different optical fiber groups, a plurality of photoelectric converters each facing an end portion of an associated one of the optical fiber groups further from the end portion facing the coin to be discriminated and being adapted for receiving the reflected light guided by the associated optical fiber group and converting it to an electrical signal proportional to the amount of the received light, and a discriminator for discriminating coins based upon the electrical signals generated by the plurality of photoelectric converters. The thus constituted apparatus can, with a simple structure, discriminate the denominations, genuineness and the like of coins by detecting coin surface unevenness.

16 Claims, 7 Drawing Sheets

COIN DISCRIMINATOR USING A PLURALITY OF OPTICAL FIBER GROUPS

BACKGROUND OF THE INVENTION

The present invention relates to a coin discriminating apparatus and, in particular, to such a apparatus which can detect coin surface unevenness and based thereon discriminate the denominations, genuineness and the like of coins with a simple structure.

DESCRIPTION OF PRIOR ART

There has been known a method for detecting coin surface unevenness by irradiating the surface of a coin, detecting light reflected by the surface of the coin and based upon this detection, discriminating the denomination, genuineness and the like of the coin.

For instance, Japanese Patent Publication No. Hei 3-63782 proposes a coin discriminating apparatus for discriminating the genuineness of coins by obliquely irradiating the surface of each coin and comparing data obtained by detecting light reflected by arcuate portions in a plurality of annular areas concentric with the center of the coin with reference data determined in advance.

Since this apparatus discriminates the genuineness of coins by detecting the unevenness of characteristic surface portions of each denomination of coin based upon light reflected from the coins, it is able to accurately discriminate coins.

However, in the case of discriminating foreign coins from predetermined coins of the same diameter, it is unnecessary to discriminate coins by detecting the unevenness of surface characteristic portions of each denomination of coin as done in the prior art apparatus. In this case, the structure of the prior art coin discriminating apparatus is unnecessarily complicated.

SUMMARY OF THE INVENTION

It is, therefore, an object of the present invention to provide a coin discriminating apparatus which can detect coin surface unevenness and based thereon discriminate the denominations, genuineness and the like of coins with a simple structure.

The above and other objects of the present invention can be accomplished by a coin discriminating apparatus comprising irradiating means for irradiating the surface of a coin to be discriminated with light normal thereto, a plurality of optical fiber groups each including a plurality of optical fibers for guiding light reflected by the surface of the coin to be discriminated, each of the optical fibers having a light receiving end portion disposed so that an imaginary extension of the center axis thereof passes through the center of the surface of the coin to be discriminated at a predetermined angle, said predetermined angle being different between different optical fiber groups, a plurality of photoelectric converting means each facing the end portion of an associated one of optical fiber groups further from the light receiving end portion facing the coin to be discriminated and being adapted for receiving the reflected light guided by the associated optical fiber groups and converting it to an electrical signal proportional to the amount of the received light, and discriminating means for discriminating coins based upon the electrical signals generated by the plurality of photoelectric converting means.

In a preferred aspect of the present invention, the light receiving end portions of the plurality of optical fibers are spaced by the same distance from the center of the coin to be discriminated.

In a further preferred aspect of the present invention, the discriminating means includes calculating means for producing detection data based upon the electrical signals and comparing means for comparing the detection data with reference data stored therein.

In a further preferred aspect of the present invention, the light receiving end portions of the plurality of optical fibers of each of the optical fiber groups are disposed to be concentric with the center of the coin to be discriminated.

In a still further preferred aspect of the present invention, the light receiving end portions of the plurality of optical fibers are supported by support means formed as a hemispherical shell.

In another preferred aspect of the present invention, the discriminating means includes amplifier means or amplifying the electrical signals.

The above and other objects and features of the present invention will become apparent from the following description made with reference to the accompanying drawings.

DESCRIPTION OF THE PREFERRED EMBODIMENTS

Figure 1:
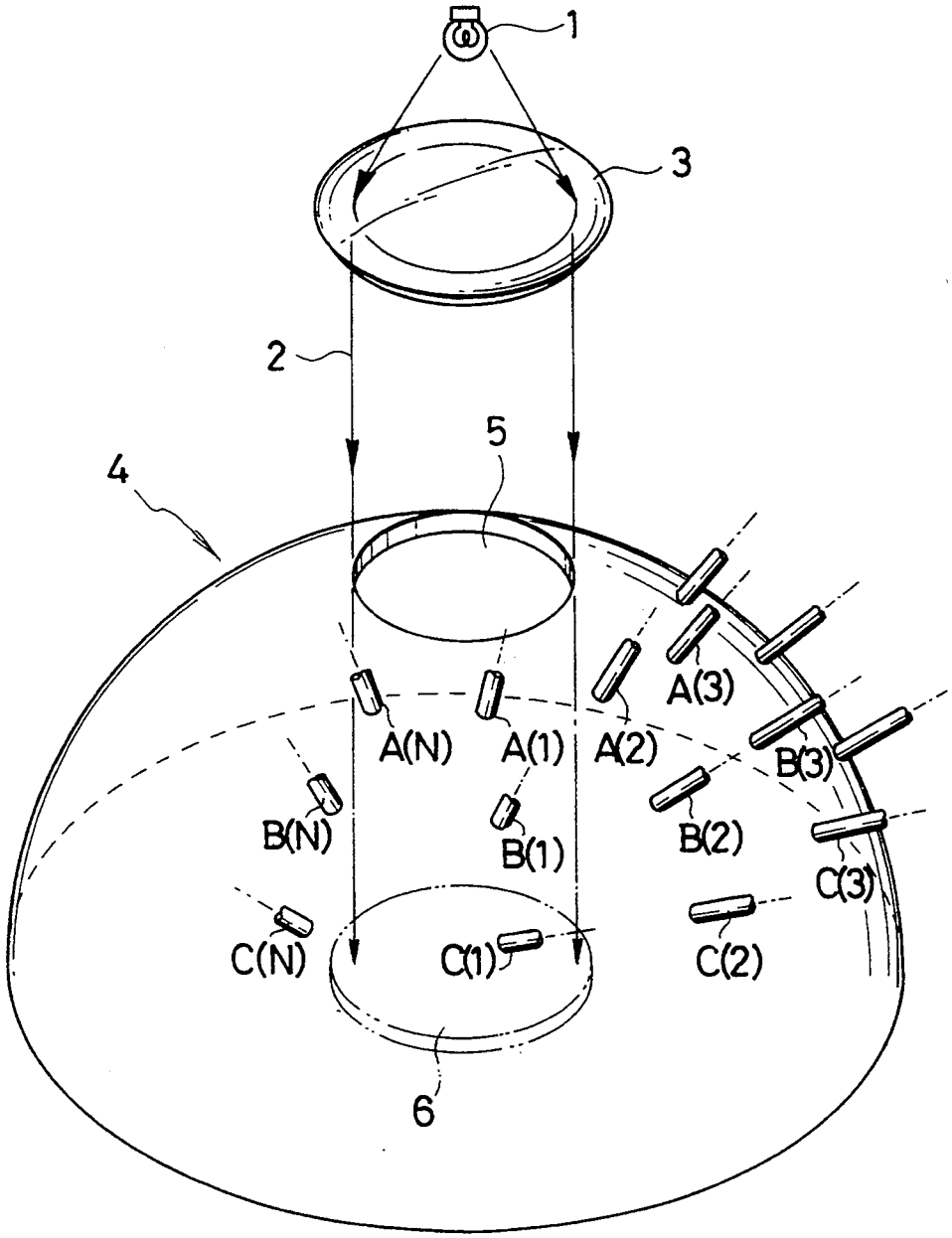
FIG. 1 is a schematic perspective view of a coin discriminating apparatus which is an embodiment of the present invention.

A coin discriminating apparatus which is an embodiment of the present invention is constituted so as to discriminate foreign coins from predetermined coins which foreign and predetermined coins cannot be discriminated from each other based upon difference in diameter therebetween. In FIG. 1, the coin discriminating apparatus comprises a light source 1, a collimator lens 3 for converting light emitted from the light source 1 to a parallel light flux 2 and a casing 4 formed as a hemispherical shell and having the top portion of the casing 4 thereof formed with a circular opening 5 the diameter of which is slightly smaller than that of coins to be discriminated.

Therefore, light emitted from the light source 1 is converted to a parallel light flux 2 by the collimator lens 3 and projected onto a coin 6 which has been transported to the coin discriminating apparatus by a transporting means (not shown) so that the center thereof is aligned with the center of the casing 4 constituted as the hemispherical shell.

Figure 2:
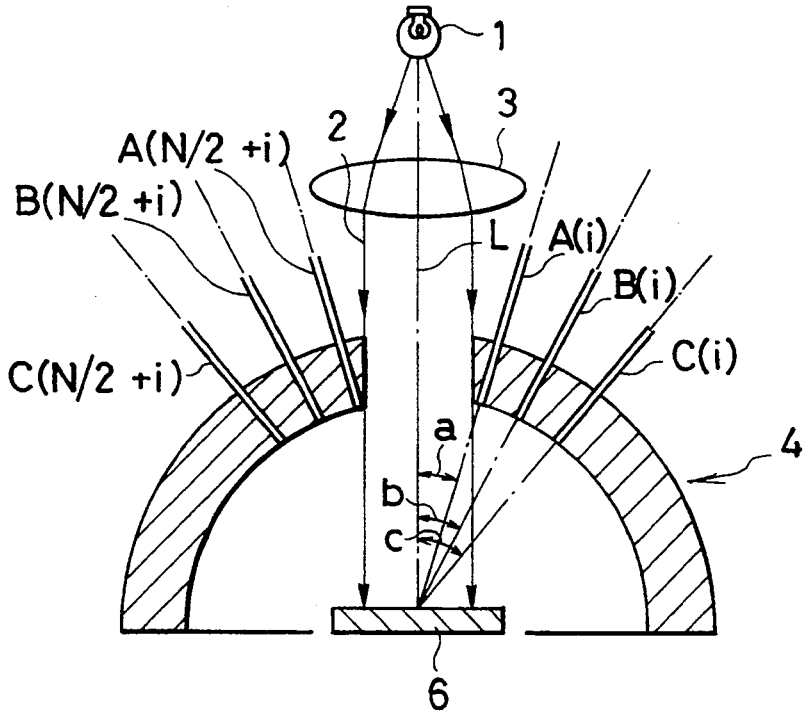
FIG. 2 is a schematic drawing showing a center lateral cross sectional view of FIG. 1.

The light receiving end portions of three optical fiber groups A, B, C are mounted on the casing 4. Each group of optical fibers A, B, C comprises N number of optical fibers A(1) to A(N), B(1) to B(N) and C(1) to C(N). The number N is a positive integer. As shown in FIG. 2, the optical fibers A(1) to A(N) constituting the optical fiber group A are disposed such that the angle between the imaginary extensions of the center axes of the light receiving end portions of the optical fibers A(1) to A(N) and the center axis L of the casing 4, namely, the imaginary extension of the center axis passing through the center of the coin to be discriminated is equal to "a". The optical fibers B(1) to B(N) constituting the optical fiber group B is disposed such that the angle between the center axes of the light receiving end portions of the optical fibers B(1) to B(N) and the center axis of the casing 4 is equal to "b". The optical fibers C(1) to C(N) constituting the optical fiber group C is disposed such that the angle between the center axes of the light receiving end portions of the optical fibers C(1) to C(N) and the center axis of the casing 4 is equal to "c". The light receiving end portions of the optical fibers A(1) to A(N) are disposed in the vicinity of the opening 5 of the casing 4 and $a<b<c$. The light receiving end portions of the optical fibers A(1) to A(N) are equally spaced from each other along a circle on the surface of the casing 4 concentric with the center axis of the casing 4. The light receiving end portions of the optical fibers B(1) to B(N) are equally spaced from each other along a circle on the surface of the casing 4 concentric with the center axis of the casing 4. The light receiving end portions of the optical fibers C(1) to C(N) are equally spaced from each other along a circle on the surface of the casing 4 concentric with the center axis of the casing 4.

In this embodiment, the number N is set to be even and, therefore, as shown in FIG. 2, the optical fibers A(i) and A(N/2+i), the optical fibers B(i) and B(N/2+i) and the optical fibers C(i) and C(N/2+i) are symmetrically disposed with respect to the center axis L of the casing 4. The number "i" is a positive integer equal to or smaller than "N/2".

Figure 3:
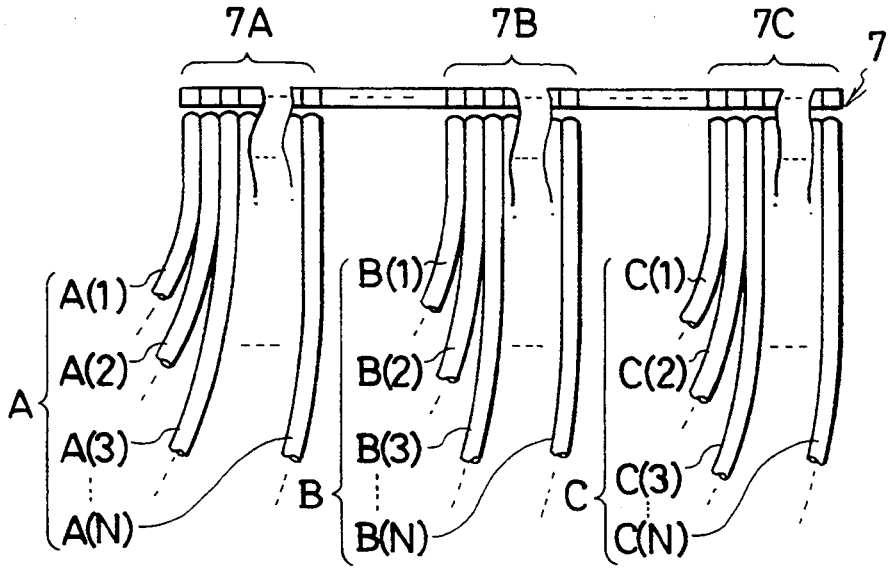
FIG. 3 is a schematic front view showing optical fibers A(1) to A(N), B(1) to B(N), C(1) to C(N) and a one dimensional image sensor.

FIG. 3 is a schematic front view showing the optical fibers A(1) to A(N), B(1) to B(N), C(1) to C(N) and a one dimensional image sensor.

In FIG. 3, the end portions of the optical fibers A(1) to A(N) further from the coin 6 are disposed to face a pixel row 7A consisting of N pixels of the one dimensional image sensor 7 so that light from each optical fiber is received by only one pixel among them. The end portions of the optical fibers B(1) to B(N) further from the coin 6 are disposed to face a pixel row 7B consisting of N pixels of the one dimensional image sensor 7 different from the pixel row 7A so that light from each optical fiber is received by only one pixel among them. The end portions of the optical fibers C(1) to C(N) further from the coin 6 are disposed to face a pixel row 7C consisting of N pixels of the one dimensional image sensor 7 different from the pixel rows 7A and 7B so that light from each optical fiber is received by only one pixel among them.

Figure 4:
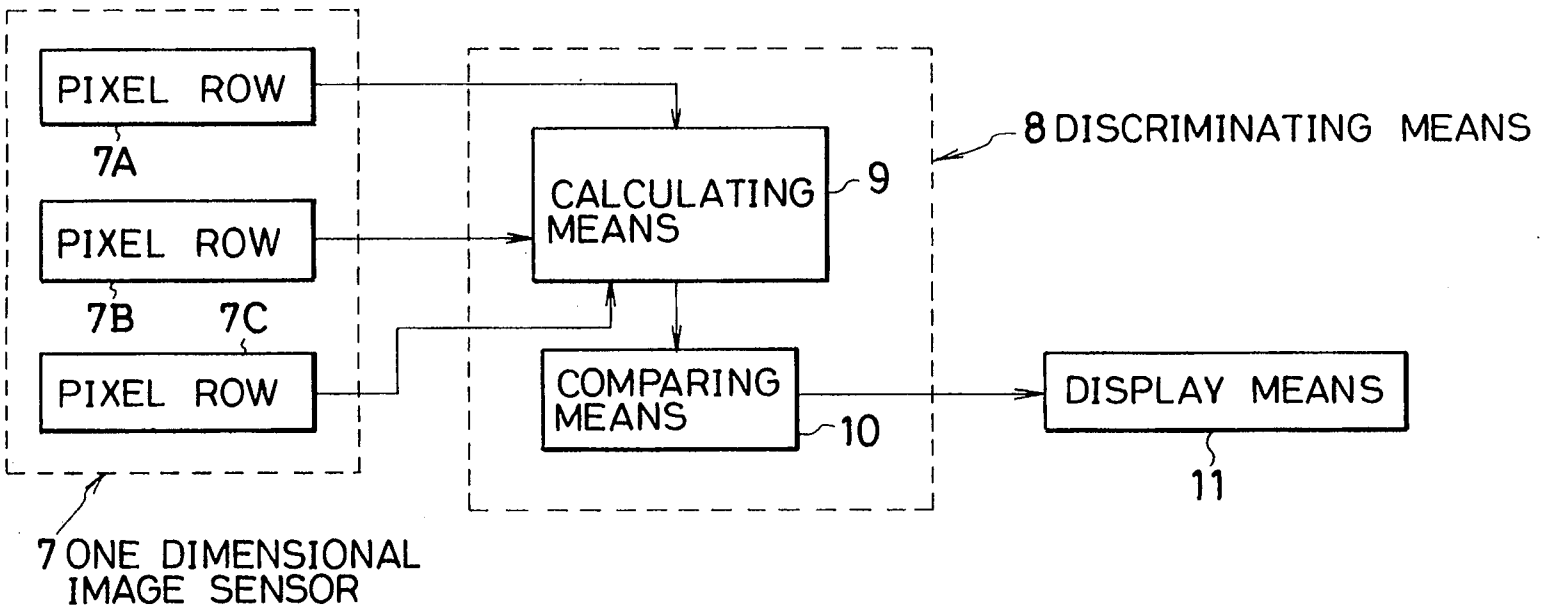
FIG. 4 is a block diagram of a detection system, a discriminating system and a display system of a coin discriminating apparatus which is an embodiment of the present invention.

FIG. 4 is a block diagram of a detection system, a discriminating system and a display system of the coin discriminating apparatus which is an embodiment of the present invention.

In FIG. 4, when a pixel row 7A, 7B, 7C of the one dimensional image sensor 7 receives light reflected by the coin 6, it converts the light to an electrical detection signal and outputs the signal to a discriminating means 8. The discriminating means 8 comprises a calculating means 9 for integrating the detection signals input from the pixel rows 7A, 7B, 7C and calculating the gradient of a detection data curve obtained by plotting the integrated values with respect to the positions of the optical fibers A(1) to A(N), B(1) to B(N), C(1) to C(N) and a comparing means 10 for comparing the gradient of the detection data curve calculated by the calculating means 9 with a reference gradient stored therein in advance to discriminate whether the coin 6 is a predetermined coin or a foreign coin and outputting a display signal to a display means 11 when it judges that the coin 6 is a foreign coin. When the display means 11 receives the display signal, it displays on a display portion (not shown) a message that a foreign coin has been detected.

The thus constituted coin discriminating apparatus which is an embodiment of the present invention operates as follows to discriminate coins.

At first, when a coin 6 has been transported to the coin discriminating apparatus by a transporting means (not shown) and it is detected that the center of the coin 6 coincides with the center of the casing 4 formed as a hemispherical shell, the light source 1 emits light. The light emitted from the light source 1 is converted to a parallel light flux 2 by the collimator lens 3 and projected onto the surface of the coin 6 normal thereto.

The light projected onto the surface of the coin 6 to be discriminated is reflected by the surface of the coin 6 and received by the light receiving end portions of the optical fibers A(1) to A(N), B(1) to B(N), C(1) to C(N). The light projected onto the surface of the coin 6 normal thereto is reflected by the flat surface of coin 6 normal thereto, whereas the light is reflected by uneven portions of the surface of coin 6 in oblique directions depending upon the angles of the surfaces of the uneven portions with respect to the horizontal plane.

Accordingly, the more uneven portions that are present on the surface of coin 6, the greater the ratio of light reflected in oblique directions becomes, whereby the amount of reflected light received by the optical fibers A(1) to A(N) constituting the optical fiber group A decreases and an amount of reflected light received by the optical fibers B(1) to B(N) constituting the optical fiber group B and the optical fibers C(1) to C(N) constituting the optical fiber group C increases. On the other hand, the fewer uneven portions that are present on the surface of coin 6, the more the optical fibers A(1) to A(N) constituting the optical fiber group A receive reflected light, whereby the amount of reflected light received by the optical fibers B(1) to B(N) constituting the optical fiber group B and the optical fibers C(1) to C(N) constituting the optical fiber group C decreases.

Each of the pixel rows 7A, 7B, 7C of the one dimensional image sensor 7 converts received light to an electrical detection signal the magnitude of which depends upon the amount of received light and outputs it to the discriminating means 8.

The calculating means 9 of the discriminating means 8 integrates the detection signals input from the pixel rows 7A, 7B, 7C of the one dimensional image sensor 7 and plots the integrated values with respect to the angles between the center axes of the optical fibers A(1) to A(N), B(1) to B(N) and C(1) to C(N) and the center axis L of the casing 4, thereby producing a detection data curve and calculates the gradient of the detection data curve for output to the comparing means 10. The greater the angle an uneven surface portion formed on the coin 6 makes with respect to the horizontal plane, the greater the amount of reflected light received by the optical fibers C(1) to C(N) constituting the optical fiber group C becomes and the smaller the angle an uneven surface portion on the coin 6 makes with respect to the horizontal plane, the greater the amount of reflected light received by the optical fibers B(1) to B(N) constituting the optical fiber group B becomes. However, since the angles of uneven surface portions formed on the surface of coin 6 are normally not great, the more uneven portions that are present on the surface of the coin 6, the greater the amount of reflected light received by the optical fibers C(1) to C(N) becomes, but the increase in the amount of reflected light received by the optical fibers B(1) to B(N) is greater than the increase in the amount received by the optical fibers C(1) to C(N). Therefore, the more uneven portions that are present on the surface of the coin 6, the smaller the gradient of the detection data curve becomes.

The comparing means 10 compares the gradient of the detection data curve input from the calculating means 9 with a reference gradient stored therein in advance to discriminate whether the coin 6 is a predetermined coin or a foreign coin.

When the comparing means 10 judges that the coin 6 is a foreign coin, it outputs a display signal to the display means 11 so as to cause it to display on a display portion (not shown) a message that a foreign coin has been detected.

Figure 5A:
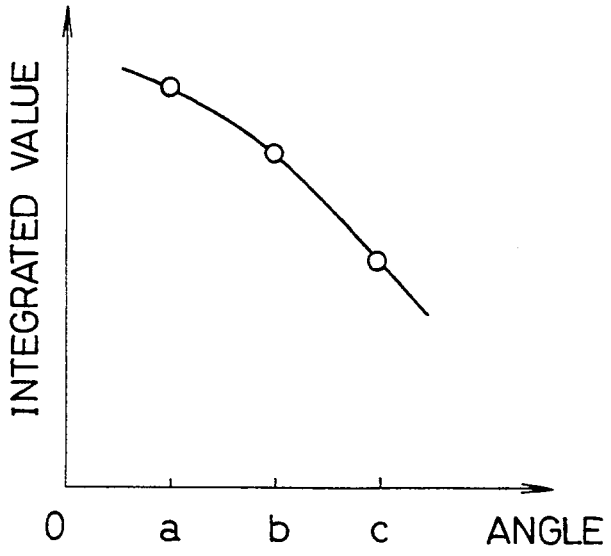
FIGS. 5 (*a*) and (*b*) are graphs showing examples of detection data curves.
Figure 5B:
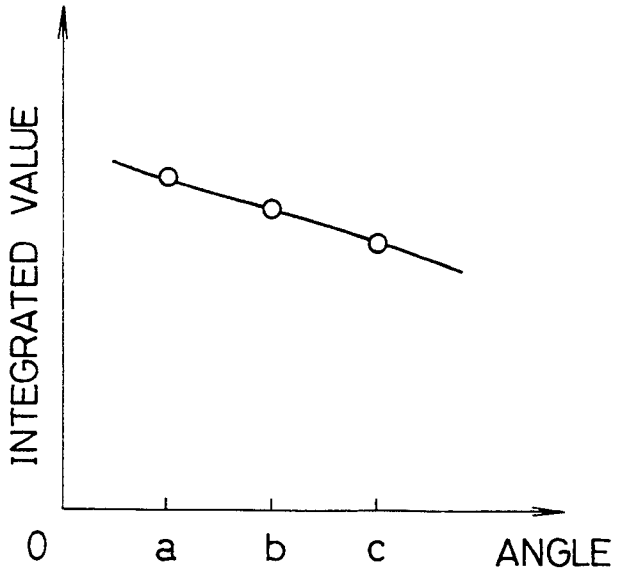

FIGS. 5 (*a*) and (*b*) show examples of detection data curves obtained by plotting integrated values of the amounts of reflected light received by the pixel rows 7A, 7B, 7C calculated by the calculating means 9 with respect to angles between the center axes of the optical fibers A(1) to A(N), B(1) to B(N) and C(1) to C(N) and the center axis L of the casing 4. FIG. 5 (*a*) shows an example of a detection data curve obtained from a coin 6 on which many uneven portions are present and FIG. 5 (*b*) shows an example of a detection data curve obtained from a coin 6 on which not so many uneven portions are present.

As apparent from FIGS. 5 (*a*) and (*b*), since the amount of reflected light received by the optical fibers B(1) to B(N) and C(1) to C(N) becomes greater in the case where many uneven portions are present on the surface of the coin 6 than in the case where not so many uneven portions are present on the surface of the coin 6, the gradient of the detection data curve becomes smaller. Therefore, by comparing the gradient of the detection data curve with the reference gradient it is possible to discriminate whether the coin 6 is the predetermined coin or a foreign coin.

According to this embodiment, it is possible to discriminate whether the coin 6 is a predetermined coin or a foreign coin only by locating the light receiving end portions of the optical fibers A(1) to A(N), B(1) to B(N) and C(1) to C(N) at their predetermined positions, respectively integrating the amounts of reflected light received thereby, calculating the gradient of the detection data curve obtained by plotting the integrated values with respect to the angles between the center axes of the optical fibers A(1) to A(N), B(1) to B(N) and C(1) to C(N) and the center axis L of the casing 4 formed as a hemispherical shell and comparing the thus calculated gradient with the reference gradient. Therefore, it is possible to discriminate coins by a coin discriminating apparatus with a simple structure.

Figure 6:
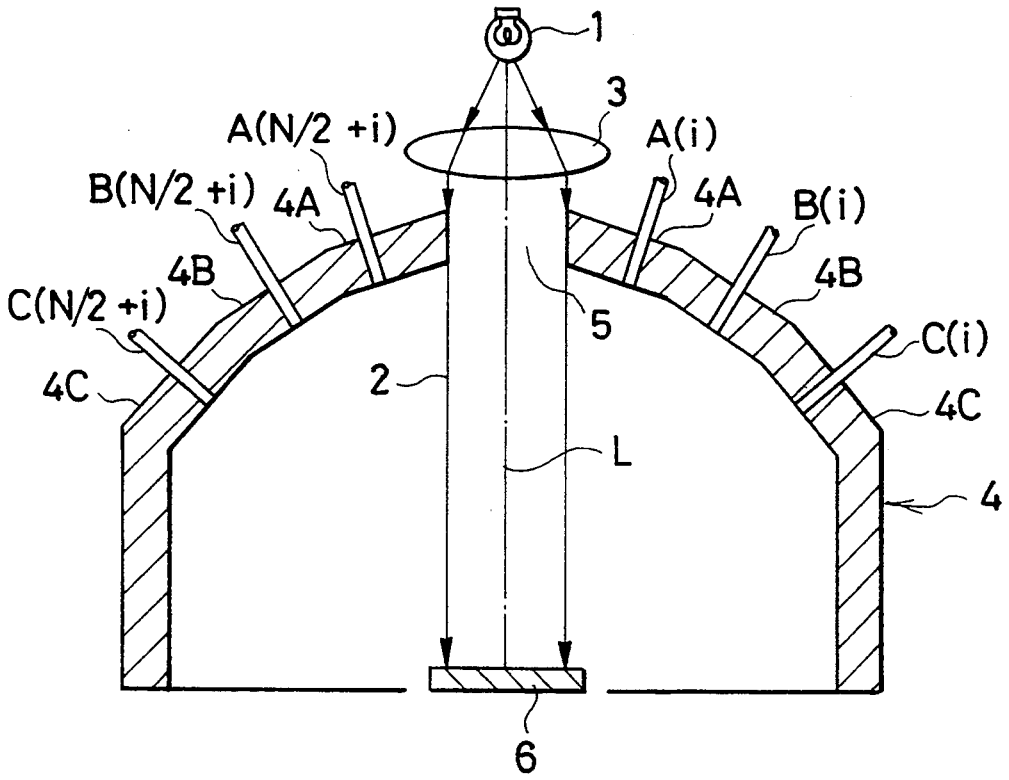
FIG. 6 is a schematic center lateral cross sectional view showing a coin discriminating apparatus which is another embodiment of the present invention.

FIG. 6 is a schematic center lateral cross sectional view showing a coin discriminating apparatus which is another embodiment of the present invention.

The coin discriminating apparatus shown in FIG. 6 has the same configuration as that in the previous embodiment except that the shape of the casing 4 is different. More specifically, although the previous embodiment is provided with the casing 4 formed as a hemispherical shell, the casing 4 of the coin discriminating apparatus according to this embodiment is constituted as a shell having four wall portions the angles of which are different from each other. Light receiving end portions of N optical fibers A(1) to A(N) are mounted on wall portion 4A. Light receiving end portions of N optical fibers B(1) to B(N) are mounted on wall portion 4B. Light receiving end portions of N optical fibers C(1) to C(N) are mounted on wall portion 4C. Each light receiving end portion of the optical fibers is oriented so that the extension of its center axis passes through the center of the shell constituting the casing 4, namely the center of the coin 6.

Similarly to the previous embodiment, the more uneven portions that are present on the surface of the coin 6, the greater the amount of reflected light received by the optical fibers B(1) to B(N) and C(1) to C(N), whereby it is possible to discriminate whether the coin 6 is a predetermined coin or a foreign coin by calculating the gradient of the detection data curve and comparing it with the reference gradient.

Figure 7:
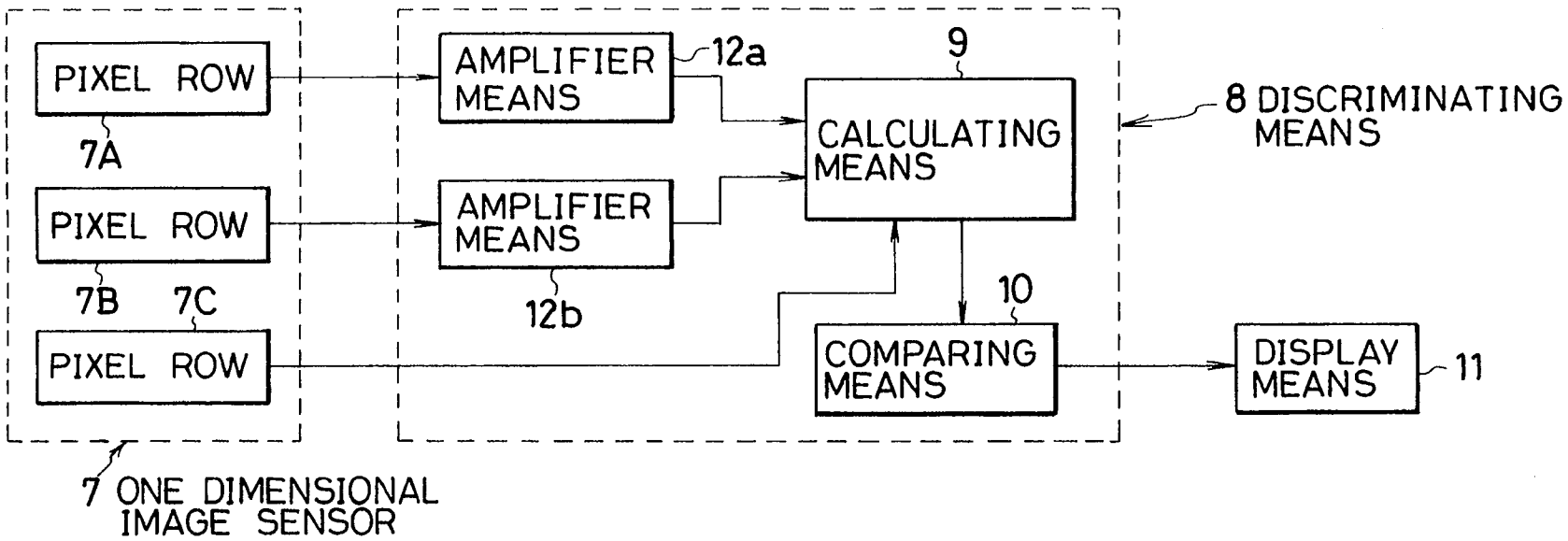
FIG. 7 is a block diagram of a detection system, a discriminating system and a display system of a coin discriminating apparatus which is another embodiment of the present invention.

However, in this embodiment, the distance between the light receiving end portions of the optical fibers A(1) to A(N) and the surface of the coin 6, the distance between the light receiving end portions of the optical fibers B(1) to B(N) and the surface of the coin 6 and the distance between the light receiving end portions of the optical fibers A(1) to A(N) and the surface of the coin 6 are different from each other, as shown in FIG. 7. Therefore, the discriminating means 8 includes amplifier means 12*a*, 12*b* each having a predetermined amplifying factor for correcting the detection signals output from the pixel rows 7A, 7B in proportion to the distances between the optical fibers and the surface of the coin 6 and outputting corrected detection signals to the calculating means 9.

The present invention has thus been shown and described with reference to a specific embodiment. However, it should be noted that the present invention is in no way limited to the details of the described arrangements but changes and modifications may be made without departing from the scope of the appended claims.

For example, in the above described embodiments, although the optical fiber group A is constituted by N optical fibers A(1) to A(N), the optical fiber group B is constituted by N optical fibers B(1) to B(N) and the optical fiber group C is constituted by N optical fibers C(1) to C(N) wherein N is determined to be an even number, N may instead be an odd number. Further, although the respective optical fiber groups A, B, C are constituted by the same number of optical fibers and the three optical fiber groups A, B, C are mounted on the casing 4 so as to be concentric with the center axis of the casing 4, if amplifier means are provided for correcting the detection signals output from the pixel rows 7A, 7B, 7C, the numbers of the optical fibers constituting the optical fiber groups A, B, C may be different and it is unnecessary to dispose the optical fiber groups A, B, C so as to be concentric with the center axis of the casing 4.

Moreover, in the above described embodiments, although an electrical signal proportional to the amount of reflected light from the coin 6 is generated using the pixel rows 7A, 7B, 7C of the one dimensional image sensor 7, it is possible to use a photoelectric converting element such as CCD (charge coupled device), a photodiode or the like which can generate electrical signals in proportion to the amount of reflected light received by the optical fibers A(1) to A(N), B(1) to B(N) and C(1) to C(N), instead of the one dimensional image sensor 7.

Further, in the above described embodiments, although a hemispherical shell or a shell having four wall portions whose angles are different from each other is used as the casing 4, the shape of the casing 4 is not limited and any casing may be used insofar as it can fix the light receiving end portions of the optical fibers A(1) to A(N), B(1) to B(N) and C(1) to C(N) such that imaginary extensions of the center axes thereof pass through the center of the coin 6 to be discriminated.

Furthermore, in the above described embodiments, although the discrimination of coins is made by comparing the gradient of the detection data curve with the reference curve, it is possible to discriminate coins by producing reference data in advance, storing them in the comparing means 10 and comparing the reference data and the detection data. In this case, even if no amplifier means is provided, it is possible to set the distances between the light receiving end portions of the optical fibers A(1) to A(N), B(1) to B(N) and C(1) to C(N) and the surface of the coin 6 to be discriminated so as to be different from each other and it is unnecessary to dispose the light receiving end portions of the optical fibers A(1) to A(N), B(1) to B(N) or C(1) to C(N) so as to be equally spaced from each other.

Figure 8:
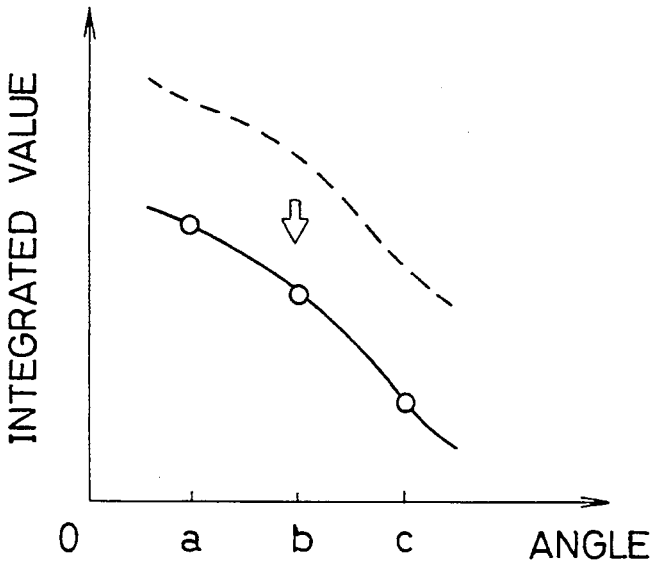
FIG. 8 is a graph showing an example of the detection data curve of a damaged coin.

Moreover, in the above described embodiments, although it is discriminated by comparing the gradient of the detection data curve with the reference gradient whether or not the coin 6 is a predetermined coin or a foreign coin, it is possible to discriminate the damage level of the coin 6 in addition to such discrimination by storing a reference amount of reflected light to be received by one of the optical fiber groups A, B or C in the comparing means 10 and comparing the amount of reflected light received by the one of the optical fiber groups A, B or C with the reference amount based upon the detection signal, or comparing the detection data with the reference data. FIG. 8 shows the detection data curve of a damaged coin produced according to the embodiment shown in FIGS. 1 to 5. Since the entire surface of a damaged coin is normally uniformly damaged, the amount of reflected light received by the optical fiber groups A, B, C is uniformly decreased and the detection data curve, which is normally as shown by the dotted line, becomes as shown by the solid line. Therefore, it is possible to further discriminate the damage level of coin 6 by calculating the gradient of the detection data curve based upon the detection signals from the one dimensional image sensor 7 and comparing the amount of reflected light received by one of the optical fiber groups A, B, C with the reference amount stored in the comparing means 10 in advance.

Further, in the above described embodiments, although light emitted from the light source 1 is converted to a parallel light flux 2 using the collimator lens 3, it is possible to provide a parallel light flux 2 onto the coin 6 using a laser source for emitting a laser beam having a high rectilinear propagation ability, instead of the light source 1 and the collimator lens 3.

Furthermore, in the above described embodiments, although three optical fiber groups A, B, C are used, this is not absolutely necessary and any number of optical fiber groups greater the one suffices.

Moreover, in the present invention, the respective means need not necessarily be physical means and arrangements whereby the functions of the respective means are accomplished by software fall within the scope of the present invention. In addition, the function of a single means may be accomplished by two or more physical means and the functions of two or more means may be accomplished by a single physical means.

According to the present invention, it is possible to provide a coin discriminating apparatus which can detect coin surface unevenness and based thereon discriminate the denominations, genuineness and the like of coins with a simple structure.

We claim:

1. A coin discriminating apparatus comprising; irradiating means for irradiating a surface of a coin to be discriminated with light normal thereto, a plurality of optical fiber groups each including a plurality of optical fibers for guiding light reflected by the surface of the coin to be discriminated, each of the optical fibers having a light receiving end portion disposed so that an imaginary extension of a center axis thereof passes through the center of the surface of the coin to be discriminated at a predetermined angle, said predetermined angle being different between different optical fiber groups, a plurality of photoelectric converting means each facing an end portion of an associated one of the optical fiber groups further from the light receiving end portion facing the coin to be discriminated and being adapted for receiving the reflected light guided by the associated optical fiber groups and converting it to an electrical signal proportional to an amount of the received light, and discriminating means for discriminating coins based upon the electrical signals generated by the plurality of photoelectric converting means.

2. A coin discriminating apparatus in accordance with claim 1 wherein the discriminating means includes amplifier means for amplifying the electrical signals.

3. A coin discriminating apparatus in accordance with claim 1 wherein the light receiving end portions of the plurality of optical fibers are spaced by the same distance from the center of the coin to be discriminated.

4. A coin discriminating apparatus in accordance with claim 3 wherein the discriminating means includes amplifier means for amplifying the electrical signals.

5. A coin discriminating apparatus in accordance with claim 1 wherein the light receiving end portions of the plurality of optical fibers of one of the optical fiber groups are disposed to be concentric with the center of the coin to be discriminated.

6. A coin discriminating apparatus in accordance with claim 5 wherein the discriminating means includes amplifier means for amplifying the electrical signals.

7. A coin discriminating apparatus in accordance with claim 1 wherein the light receiving end portions of the plurality of optical fibers are supported by support means formed as a hemispherical shell.

8. A coin discriminating apparatus in accordance with claim 7 wherein the discriminating means includes amplifier means for amplifying the electrical signals.

9. A coin discriminating apparatus in accordance with claim 1 wherein the discriminating means includes calculating means for producing detection data based upon the electrical signals and comparing means for comparing the detection data with reference data stored therein.

10. A coin discriminating apparatus in accordance with claim 9 wherein the discriminating means includes amplifier means for amplifying the electrical signals.

11. A coin discriminating apparatus in accordance with claim 9 wherein the light receiving end portions of the plurality of optical fibers are spaced by the same distance from the center of the coin to be discriminated.

12. A coin discriminating apparatus in accordance with claim 11 wherein the discriminating means includes amplifier means for amplifying the electrical signals.

13. A coin discriminating apparatus in accordance with claim 9 wherein the light receiving end portions of the plurality of optical fibers of one of the optical fiber groups are disposed to be concentric with the center of the coin to be discriminated.

14. A coin discriminating apparatus in accordance with claim 13 wherein the discriminating means includes amplifier means for amplifying the electrical signals.

15. A coin discriminating apparatus in accordance with claim 9 wherein the light receiving end portions of the plurality of optical fibers are supported by support means formed as a hemispherical shell.

16. A coin discriminating apparatus in accordance with claim 15 wherein the discriminating means includes amplifier means for amplifying the electrical signals.

* * * * *